US006565449B2

(12) United States Patent
Buhler

(10) Patent No.: US 6,565,449 B2
(45) Date of Patent: May 20, 2003

(54) ATHLETIC BALL IMPACT MEASUREMENT AND DISPLAY DEVICE

(76) Inventor: Kirk Alyn Buhler, 2687 Scenic Crest La., Corona, CA (US) 92881-3551

( * ) Notice: Subject to any disclaimer, the term of this patent is extended or adjusted under 35 U.S.C. 154(b) by 25 days.

(21) Appl. No.: 09/777,197

(22) Filed: Feb. 5, 2001

(65) Prior Publication Data

US 2002/0107077 A1 Aug. 8, 2002

(51) Int. Cl.[7] ..... A63B 67/02; G06F 15/00

(52) U.S. Cl. ..... 473/151; 702/189

(58) Field of Search ..... 473/140–146, 473/151–154, 155–156, 198–199, 202, 213, 222, 225, 422, 450, 455, 458, 453, 459, 463–465, 570–571; 702/116, 141, 189, 199; 340/323 R; 273/317.1–317.6, 108.2

(56) References Cited

U.S. PATENT DOCUMENTS 4,237,736 A 12/1980 Wright
4,898,389 A * 2/1990 Plutt ..... 473/223
5,062,641 A 11/1991 Poillon et al.
5,233,544 A * 8/1993 Kobayashi ..... 702/141
5,401,026 A * 3/1995 Eccher et al. ..... 473/199
5,605,326 A 2/1997 Spear, Jr.
5,626,526 A 5/1997 Pao et al.
5,757,266 A * 5/1998 Rider et al. ..... 340/323 R
5,908,194 A 6/1999 Schachter et al.
6,042,483 A 3/2000 Katayama
6,148,271 A * 11/2000 Marinelli ..... 702/141

OTHER PUBLICATIONS

Len Vermillion, a Sizzling New Swing, PD & D Magazine, Sep. 1998, p. 50, Published in USA.

* cited by examiner

*Primary Examiner*—Kim Nguyen
(74) *Attorney, Agent, or Firm*—Kirk Alyn Buhler; Buhler Associates Patents & Engineering

(57) ABSTRACT

Sports related self-contained impact detection and display device that allows the bat, racquet, club, or ball to determine the intensity of the impact and provide an estimate on the speed, force, direction or distance that would result from the impact. The device is self-contained and allows the device to be mounted within or on the bat, racquet, club or ball. In addition to estimation of speed, force, direction or distance the device can collect multiple impacts and provide minimum, maximum, average, sum and totals of the impacts. The user interface can also provide a graphical representation of the resulting trajectory or flight of the object being impacted.

20 Claims, 6 Drawing Sheets

ATHLETIC BALL IMPACT MEASUREMENT AND DISPLAY DEVICE

FIELD OF THE INVENTION

The invention relates to an athletic impact detection and display device that may be used to estimate the impact location, force and resulting reaction exerted on a ball or similar object.

BACKGROUND OF THE INVENTION

In sporting events where a ball is struck with a bat, club, racket or similar device, the force of the impact determines how far and/or fast a ball might travel. The difference between how hard the ball is struck can be the difference between winning and losing a game. When practicing for many of these events the distance traveled by the ball can be determined by measuring the distance from the point of impact with the ball to the landing or resting location of the ball. This requires a field large enough for the ball to make a complete travel from where it is hit to where it lands.

If two balls are struck with the same force, and one ball travels parallel with the ground, and the other ball travel up at an angle, the distance traveled by each ball would be different. It would require measuring the distance traveled by each of these balls, angle of trajectory, wind speed, and direction to determine the force of the impact. Changes in stance or swing can make a difference in the how hard the ball is struck and ultimately how far the ball might travel. The concept of how hard the ball is struck is easy to relate to a baseball, and the same principles exist in tennis, golf or any game where a bat, club, racket or similar instrument makes contact with a ball, puck, or other object. For a golf club or tennis racket, multiple sensors can be installed that provide feedback on impact force, location, and direction to determine chipping and slicing of the ball, as well as spin. In addition to displaying a single value on the intensity of an impact, the ideal device could collect a number of readings and display minimum, maximum, average, total number of hits, keep score, or determine other mathematical relationship. The ideal device would provide all these features in a design that would be small enough that it could be located on or within the handle or transmitted to a wrist mounted device in close proximity. The device should also require minimal or no additional equipment beyond the object being swung, the object being impacted, and not restrict normal game playing.

U.S. Pat. No. 5,605,326 by Spears, Jr. discloses a ball mounted on a swing arm. When the ball is struck the invention calculates the resulting impact and trajectory. While this device is capable of determining the force of the impact and the trajectory it requires an external device and the user strikes a fixed object that may not simulate a ball being thrown to the person batting. In addition this device cannot be used in normal game play.

U.S. Pat. No. 6,042,482 by Katayama allows the user to strike a golf ball sitting on top of a golf Tee. When the golf ball is struck the ball is tracked through two shutters that calculate the speed and trajectory of the ball. It then determines where the ball might land. This device provides the user with an estimate of how hard the ball is struck and where the ball might land, but it requires significant additional equipment to make these calculations. While this invention allows the user to strike the ball as it would be struck in when playing the sport it cannot be used for normal golf playing.

U.S. Pat. No. 4,801,880 by Koike calculates the impact of a tennis ball. This invention allows the person to strike a tennis ball that is sent to the user. This invention calculates the force that the ball was struck by knowing where the person was standing when the ball is hit, when and where the ball lands. This invention like the others requires additional equipment to determine the force of the impact. While this device may be used on a tennis court, most of the apparatus used to determine how hard the ball is struck sits in the opponent's tennis court.

While these devices provide the user with information regarding the impact they all require additional equipment beyond the basic two items used in the sport like a bat and ball. In addition the cost and set-up of the equipment may be extensive. Also most of these devices do not allow for normal playing of the sport. All these devices fall short of providing a simple cost effective force detecting and display device that may provide the user with feedback on how they are improving. In addition, prior art may not keep track of accumulated information like minimum, maximum, average, total number of impacts, score or other mathematical relationships.

SUMMARY OF THE INVENTION

Methods and apparatus are provided herein that provide a user a simple method to determine the impact intensity. The internal electronics allow simple user interface and control over sophisticated sensing and display means. In one aspect of a particular class of embodiments, the user can toss a ball into the air and hit the ball with the bat. The electronics then determine the intensity of the impact and convert the impact into a distance. In another aspect of the preferred embodiment multiple sensors can determine the direction of the flight. In still another aspect of the preferred embodiment the detection device contains a processing means that can retain multiple impacts and can determine mathematical relationships between numerous impacts. In yet another aspect of the preferred embodiment the device can provide a numerical and or graphical display to estimate the trajectory or travel of the object impacted. In yet another aspect of the preferred embodiment a sound transducer can be installed that simulated a cheering crowd or other sound to indicate the result of the impact. It is contemplated that the device be small enough in size to fit within a standard bat, racket or club, as well as be mountable on an existing bat racket or club. The invention could reside within a golf club, and the user interface be wrist mounted. In another aspect of the preferred embodiment the power supply can be either batter or solar so the long-term data can be retained for future comparison or downloading into a computer.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
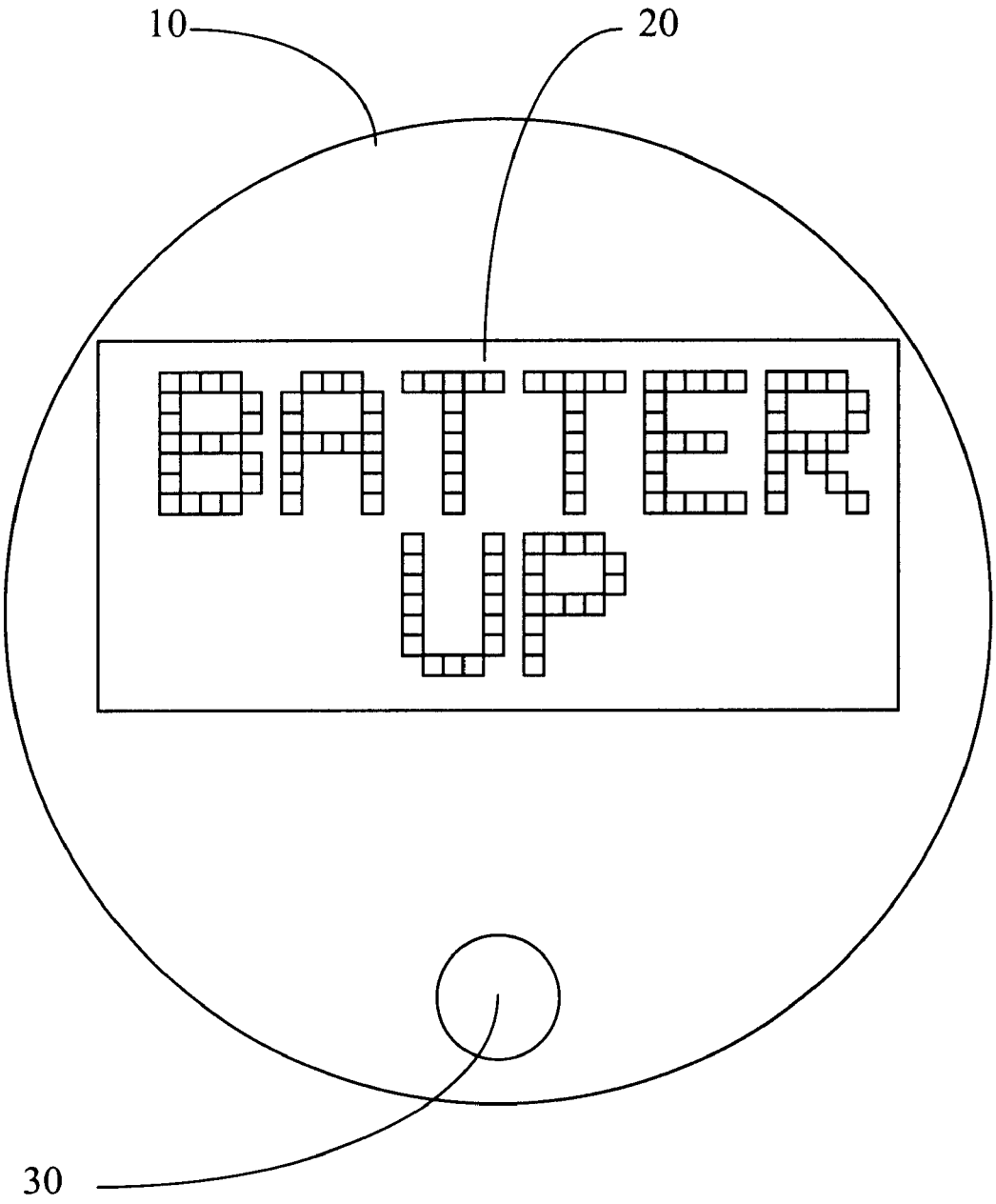
FIG. 1 is a view of the display of the invention mounted in the end of a baseball bat.
Figure 2:
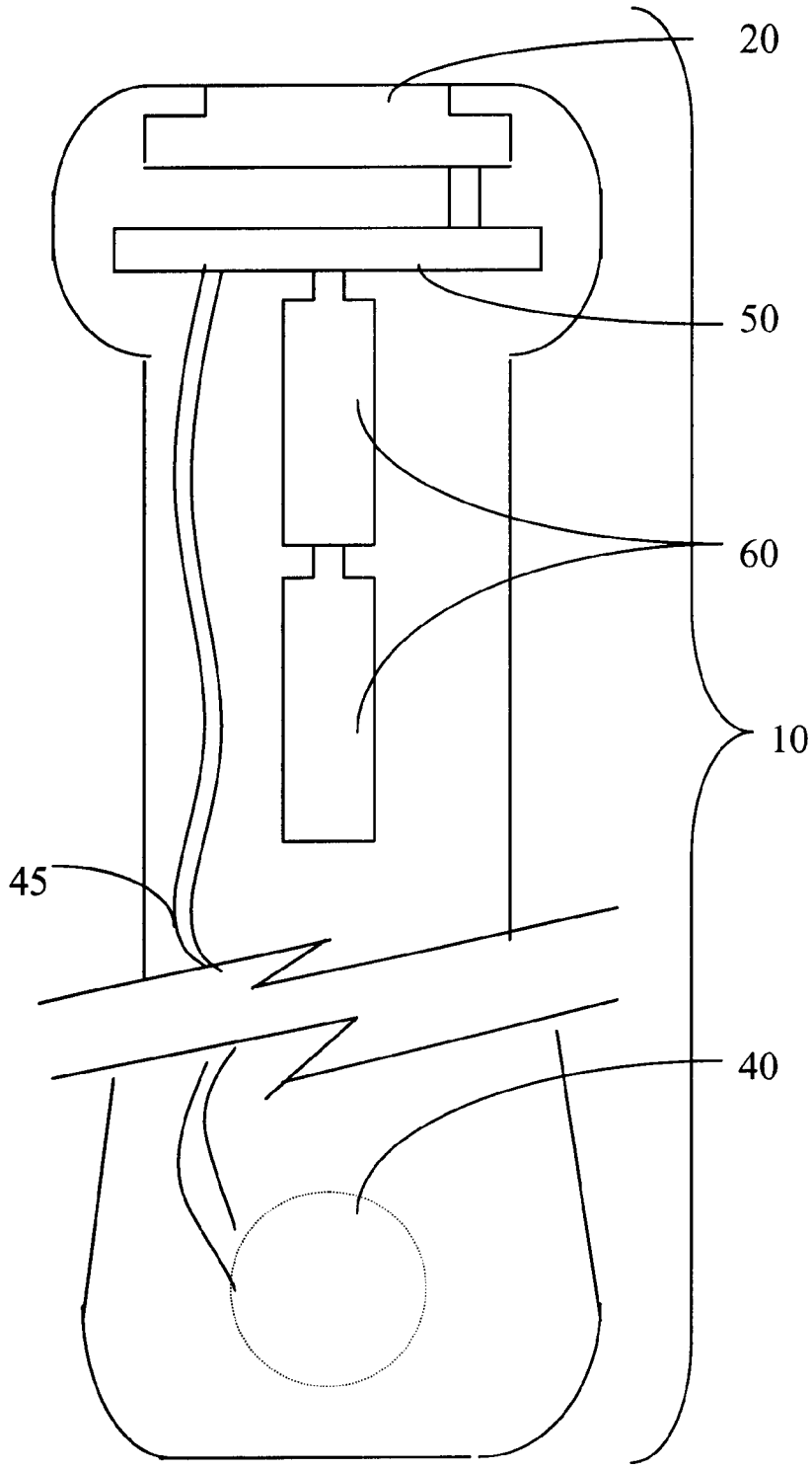
FIG. 2 is a cross section of the invention in a baseball bat.
Figure 5:
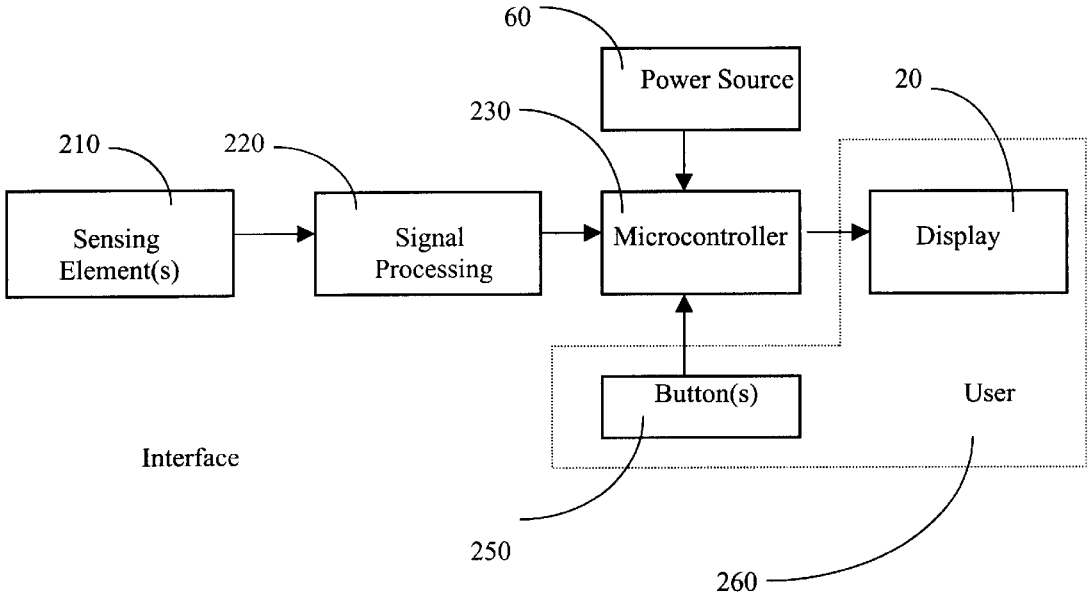
FIG. 5 is a block diagram of the invention.
Figure 6:
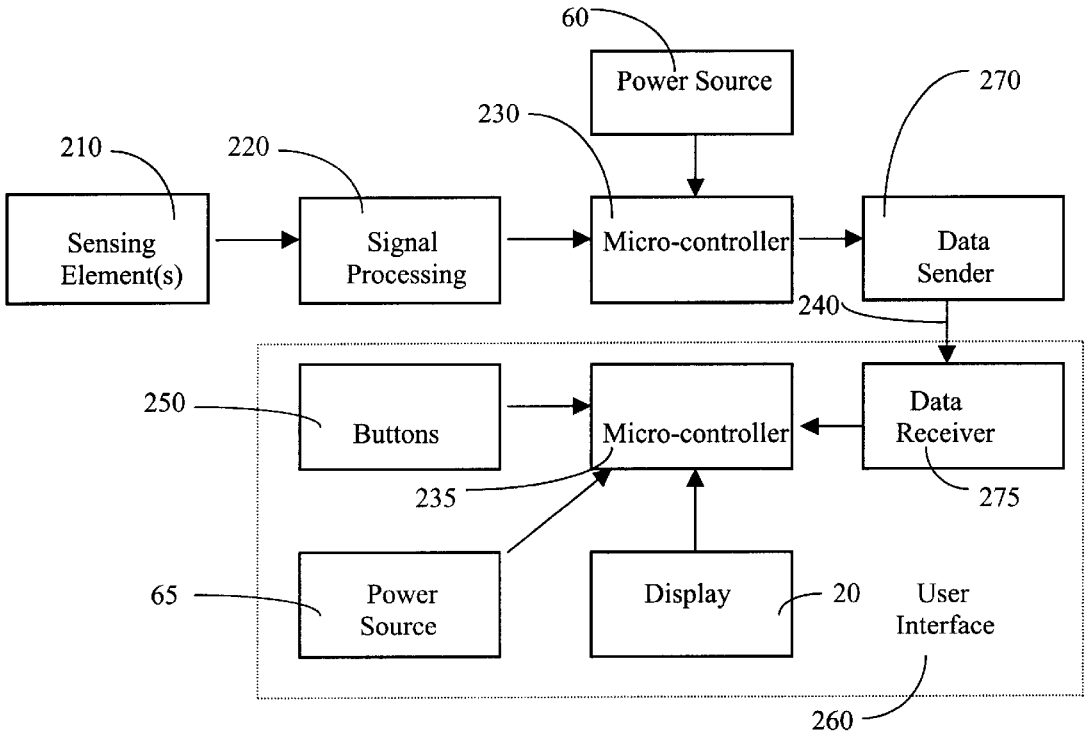
FIG. 6 is an alternative block diagram where the display is separate and wrist mounted.

The device consists of six major components. FIG. 5 shows these components where the user interface 260 is integrated within the bat, club, or racket. FIG. 6 shows these components where the user interface 260 is external to the bat, club, or racket, as might be mounted on a wrist or sent to a PC. Referring to FIG. 5 the six major components are the sensing element(s) 210, optional signal processing 220, the micro-controller 230, the power source 60, the user interface 260, consisting of a display 20, and buttons 250 and the bat, club, or racket 10 as shown in FIGS. 1 and 2. Referring to FIG. 6 the sensing element(s) 210, optional signal processing 220, the micro-controller 230, the power source 60, and data sender 270 are located in the bat club or racket, and communicatively coupled 240 to a separate user interface 260 consisting of a data receiver 275, micro-controller 235, buttons 250, display 20, an power source 65.

Figure 3:
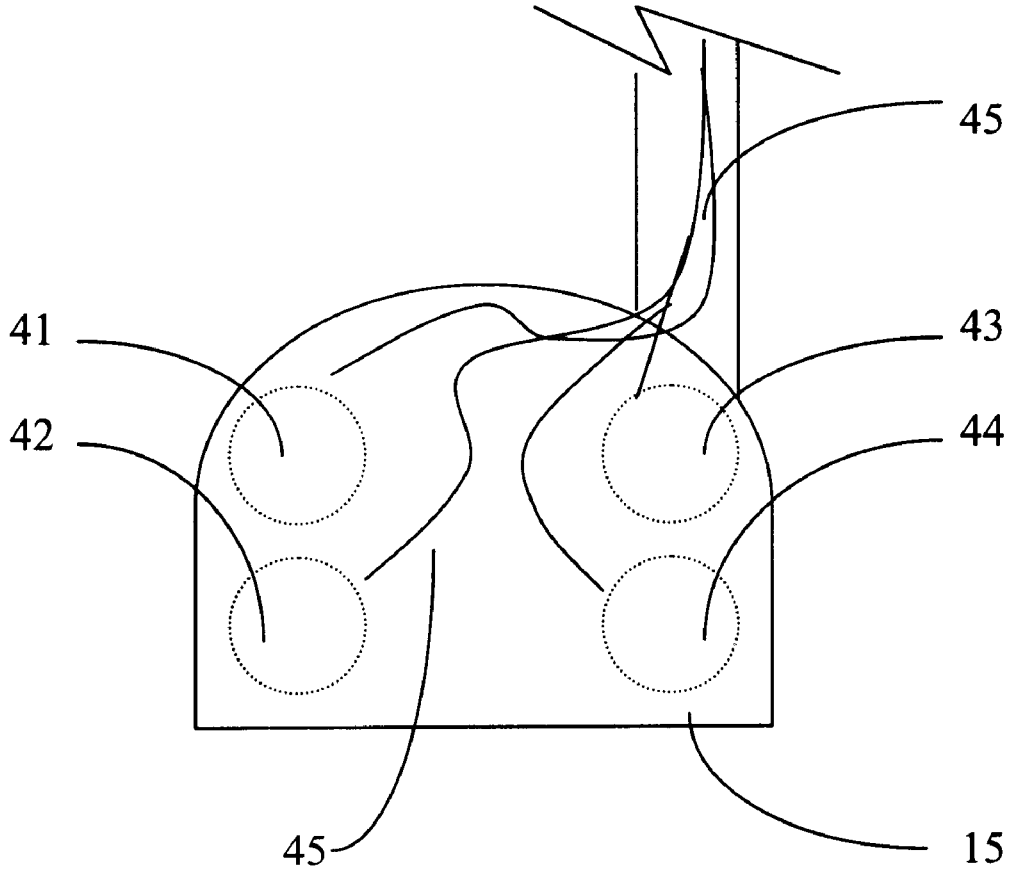
FIG. 3 is a cross section of the multiple sensors mounted in the head of a golf club.
Figure 4:
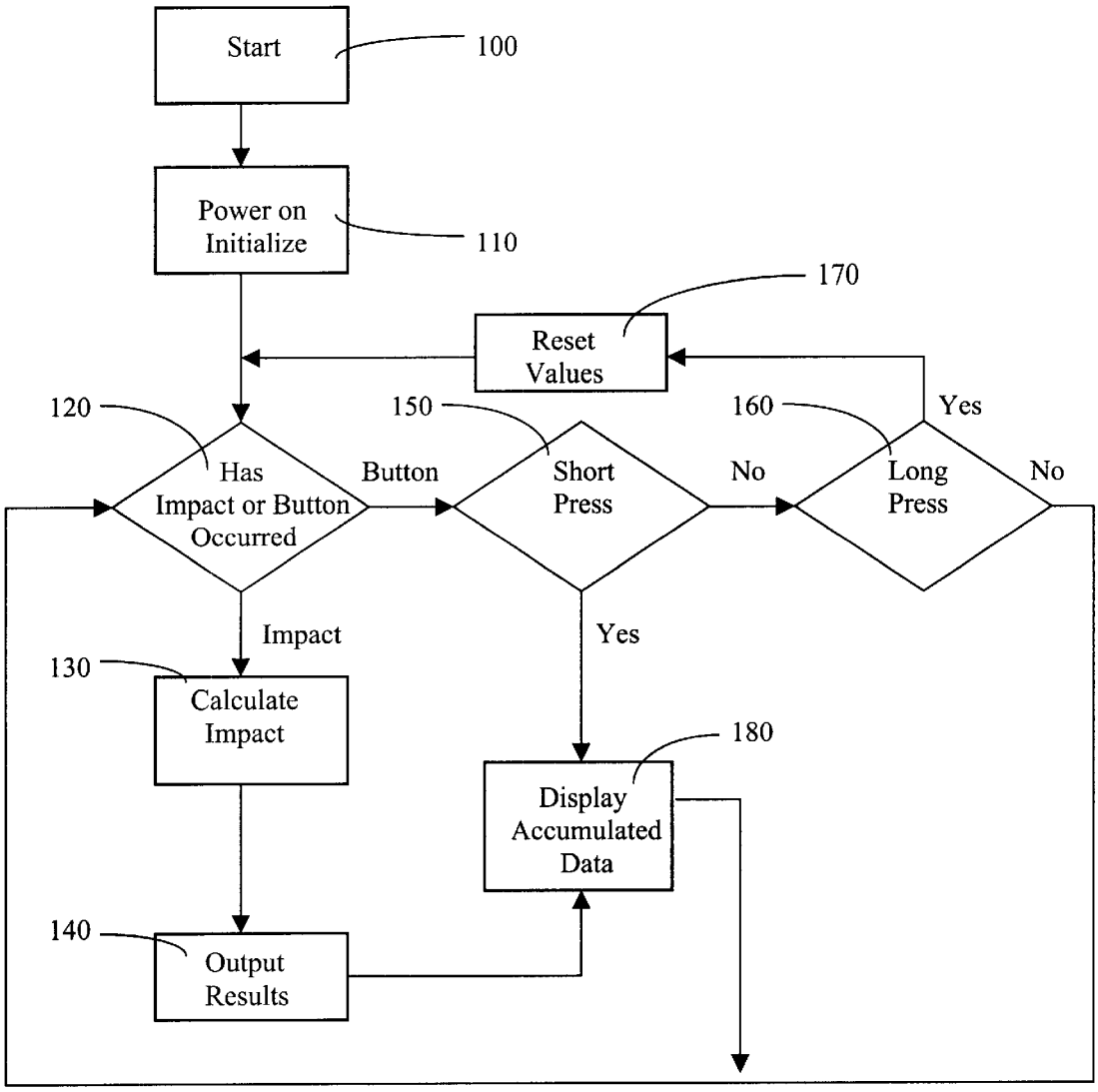
FIG. 4 is a block diagram of the program flow of the invention.

The sensing element(s) 40 as shown in FIG. 2 and 41 through 44 as shown in FIG. 3 provide an output proportional to the impact intensity. The sensing clement(s) can be a variety of types including piezo, strain gauges, capacitance or others. The sensing elements can include multiple sensors as shown in FIG. 3 items 41 through 44. In addition sensing elements can include gyros and position sensors that can determine position or angle of the bat, club, or racket to estimate the trajectory. In the preferred embodiment a piezo electric transducer is used. This type of sensing element requires reduced electronics, namely an amplifier for the sensor, it is reliable, and does not exhibit drift. When the piezo element undergoes compression or stress from the impact it outputs voltage proportional to the stress. A variety of alternate sensor types can be used to determine the intensity of the impact as well as alternate locations and positions for the sensor.

The optional signal processing means 220 consists of using the signal from the sensing element(s), and then passing the signal through a optional half or full wave bridge. The bridge is used to convert the signal from the sensing element(s) to a single polarity. Two of the bridge diodes may be a zener type. The zener diodes are used to limit the voltage to the Analog to digital (A/D) converter to protect voltage sensitive components. The signal then charges a capacitor so the peak value and duration of the impact can be determined. A resistor and capacitor (RC) network is used to create a discharge time constant that is used to store the impact intensity and duration. The capacitor is then drained by the resistor to bleed off the charged capacitor over time. An A/D converter is connected to the capacitor that measures the charged voltage, and provides a intensity value. Working prototypes have also been made without signal processing means where the signal from the sensing element(s) is/are stored in the R/C network and the time for the discharge is proportional to the impact intensity. Additionally, other working units have been made where the A/D is an integral part of the micro-controller.

The micro-controller 230 monitors the A/D converter or sensor, and determines if any changes indicate an impact. If an impact has been detected, the micro-controller continues to monitor the A/D and converts the reading(s) into intensity, distance, or speed, and then display the information. The micro-controller can also accumulate data to determine the number of impact, minimum, maximum impact force and/or the average impact intensity. The micro-processor may also provide a power latching function consists of using one of the I/O ports from the micro-controller to provide a ground connection to the peripheral devices, LCD, A/D and/or other devices. After a period has elapsed with no impacts or user interaction, the micro-controller may place itself in a lower power mode that makes the device draw less power to extend battery life. The lower power mode may be achieved by floating a I/O pin that provides the ground connection. When the I/O is not providing a ground connection, the devices will turn off. The invention may remain in this mode until the microcontroller is awakened, reset, or power is removed and re-applied.

The power supply 200 consists of one or more batteries, but the use of various other battery types, storage capacitor, solar or external power supply provide equal performance. The batteries may be filtered and pass through a normally closed switch, a zener diode, or voltage regulator, or other component to provide a stable voltage to the invention.

In the preferred embodiment the user interface consists of discrete buttons, but could be a slider or rotary control. A speaker could also be a part of the user interface. In the preferred embodiment the user interface consist of a 2 lines by 8-character LCD display 260 or matrix display. The LCD is capable of displaying standard ASCII characters as well as custom and changeable characters or symbols. The matrix display would allow motion and information to be displayed as arranged dots in a matrix. The LCD is used in the preferred embodiment because of the good readability in bright sunlight, and the low power consumption. When the invention is displaying the distance for the ball travel, the micro-controller can show a simulated flight for the path of the ball in flight. The simulated path consists of multiple images that are moved or changed in the 2 lines by 8-character screen to simulate the vertical and horizontal travel of the ball from the impact through the air, as it bounces lands and rolls to a stop. The accumulated data may be downloaded to a PC after or during the sport for additional evaluation.

The club, bat or racket can be a standard club bat or racket used to strike a ball or other object, that has been manufactured or modified to accept the sensor, monitoring, user interface and power supply. The device may also be strapped externally to an existing bat, racket, club, without modifying the athletic equipment. When the invention is an integral part of the equipment sensor(s) can be mounted in a slot or on a surface of the equipment. Referring to FIG. 2 that show a cross section of a baseball bat with one sensing element 40. Multiple sensors as shown in FIG. 3 items 41 to 44, can be used to determine where the impact occurred on a club. With the multiple sensors the trajectory and spin may be determined. Multiple sensors can also be placed on a racket to determine where the racket and ball made contact. Additionally the sensors can be combined with position sensors and/or gyros that can provide information on the angle of the racket or bat to estimate impact intensity as well as ball trajectory.

The basic operation of the invention is shown in diagram 4. When the invention is turned on or reset 100 the invention performs an initialization 110. The initialization may simple such as having the micro-controller display a message on the display. The initialization may be more complex like performing a memory check where the memory is first filled with zeros then ones, and checking/calibrating the sensor(s). If the user interface is not physically connected to the sensors then the initializations may include sending/receiving information with the user interface and checking that the communication is acceptable.

After the initialization is complete the micro-controller monitors the sensors to determine if an impact or button press has occurred, 120. Monitoring of the impact can range from reading a single input pin of the micro-controller to determine if it changes state, to reading serial or parallel information from one or more sensors. If the sensor(s) require A/D conversion, the micro-controller initiates the conversion, by reading the value(s), and compare the value (s) to a threshold. If a reading exceeds the threshold, the micro-controller calculates the result of impact intensity 130. The result of the impact intensity can be determined by comparing the value to a look-up or calculating the result using a regression equation. The micro-controller outputs the results 140. The output may be a visual display of the trajectory. It may be an audible sound like the response from a crowd. The output may be a number equivalent to the impact. This data is converted into flight and roll, the speed, and/or the impact intensity. The invention may then show a simulated flight and roll, and then display the distance and/or the resulting speed of the ball. The impact may be accumulated and stored. The accumulated information may be displayed 180 as a total or as a mathematical relationship. Following the output of the information the micro-controller returns to the monitoring mode 120.

While monitoring, if a button is pressed, the micro-controller could perform the function of displaying any accumulated information 180 determine mathematical calculated information. If another button is pressed or the button is held for a longer duration 160 the micro-controller could provide a different function like clearing some or all accumulated information 170 before returning to the monitoring mode 120. The result of the button(s) or other user input could vary based upon what data is displayed/stored and what the user expects from the interface. Another button could be pressed that would transmit data to a PC for additional evaluation or saving.

Thus, specific embodiments and applications of methods of detection, calculating, and displaying the result of an impact it should be apparent, however, to those skilled in the art that many more modifications besides those described are possible without departing from the inventive concepts herein. For example the sensing method could be an accelerometer, angular, elevation, attitude, or global positioning device placed inside the bat, club, racket, or ball, and send a signal back. Similarly, it is possible to utilize various types of user input controls, or displays such as sliders, encoders, touch screens, switches, LED's, speech/voice, or similar devices, which affects the feedback to the user. The inventive subject matter, therefore, is not to be restricted except in the spirit of the appended claims.

What is claimed is:

1. A sports related impact intensity detection and display device wherein the device is integrated in a bat, club, or racket comprising;

a sensing means located in the bat, club or racket that generates an electrical signal proportional to the intensity of an impact with an object;

a converter means that converts the proportional electrical signal to a digital signal;

a computing means that uses a regression equation to convert the digital signal to an impact intensity value;

a power source means that provides electrical power to the converter means and the computing means; and a user interface means that is connected to the computing means to provide a display of the impact intensity value.

2. The sensing means of claim 1 that includes a signal processing means.

3. The sensing means in claim 1 wherein the sensing means is a piezo electric device.

4. The sensing means in claim 1 wherein the sensing means is a strain gauge.

5. The signal processing means from claim 2 wherein the proportional electrical signal is processed with an amplifier prior to conversion to the digital signal.

6. The regression equation of claim 1 wherein the regression equation further converts the digital signal into distance, trajectory, direction, or ball speed.

7. The sports related impact intensity detection and display device of claim 1 in which multiple impact intensity values can be accumulated and a number of impacts, a maximum impact intensity value, a minimum impact intensity value, and an average impact intensity value can be determined.

8. The power source means of claim 1 wherein the power source is from batteries.

9. The power source means of claim 1 wherein the power source is from solar cells.

10. The power source means of claim 1 wherein the power source is from a storage capacitor.

11. The interface means from claim 1 wherein the interface is with buttons or knobs.

12. The interface means from claim 1 wherein the interface is with a display or sound.

13. The display from claim 12 wherein the display is LED or LCD.

14. The interface means from claim 1 wherein the interface is wrist mounted.

15. A sports related impact intensity detection device comprising:

a sensing means, located in a bat, club or racket that generates an electrical signal proportional to the intensity of an impact with an object;

an analog to digital converter that converts the proportional electrical signal to a digital signal;

a first computing means that uses a regression equation to convert the digital signal to a digital intensity value;

a data sender means that transmits the digital intensity value;

a first power supply means to supply power to the converter, to the first computing means and the data sender means, all integrated within the bat, club, or racket and is communicatively coupled to a separate user interface that is not integrated within the bat, club, or racket;

the separate user interface comprising:

a data receiver means that receives the digital intensity value;

a second computing means that converts the digital intensity value into an impact intensity value;

a user interface means to display the impact intensity value; and a second power supply means to supply power to the data receiver means, the second computing means and the user interface means.

16. The separate user interface from claim 15 wherein the communicative coupling is wireless.

17. The separate user interface from claim 15 wherein the separate user interface comprises a display, button, speaker, and computer link.

18. The separate user interface from claim 15 wherein the separate user interface is wrist mounted.

19. A sports related self contained impact intensity measurement and display device that can be swapped externally to an existing bat, club or racket comprising:

a sensing means located within the device that upon impact of an object with the bat, club or racket generates an electrical signal that is proportional to the impact intensity;

a converter means that converts the proportional electrical signal to a digital signal;

a computing means that uses a regression equation to convert the digital signal to an impact intensity value;

a user interface means connected to the computing means to provide a display of the impact intensity value; and a power source means that provides electrical power to the converter means, the computing means, and the user interface means.

20. The impact intensity measurement and display device in claim 19 wherein the display of the impact intensity represents intensity, distance, and speed.

* * * * *